United States Patent [19]

Wennerstrum et al.

[11] Patent Number: 4,882,851

[45] Date of Patent: Nov. 28, 1989

[54] APPARATUS AND METHOD FOR BATCH DRYING USING A MICROWAVE VACUUM SYSTEM

[75] Inventors: Scott Wennerstrum, Chicago; Albert Kircher, Jr., Hinsdale, both of Ill.

[73] Assignee: The Fitzpatrick Co., Elmhurst, Ill.

[21] Appl. No.: 37,610

[22] Filed: Apr. 13, 1987

[51] Int. Cl.[4] ..... B01K 5/00

[52] U.S. Cl. ..... 34/60; 34/77; 34/133; 34/45

[58] Field of Search ..... 34/1, 77, 133, 109, 34/92, 68, 242, 45, 60

[56] References Cited

U.S. PATENT DOCUMENTS

| | | | |
|---|---|---|---|
| 4,240,453 | 12/1980 | Vail et al. | 34/77 |
| 4,250,628 | 2/1981 | Smith et al. | 34/1 |
| 4,426,794 | 1/1984 | Vanderheisden | 34/109 |
| 4,622,446 | 11/1986 | Sugisawa et al. | 34/1 |

OTHER PUBLICATIONS

Doyle, et al., Microwave Drying for Highly Active Pharmaceutical Granules published in "Manufacturing Chemist" Feb. 1987.

T. K. Fielder, Microwave Vacuum Dryer brochure, dated May 1988.

Cliff, Applications of Microwaves in the Pharmaceutical Industry, published at the Institution of Chemical Engineers Northwester Branch Papers 1986.

Waldron, Microwave Vacuum Drying of Pharmaceuticals: The Development of a Process, undated.

Raymond Automation, Microwave Vacuum Dryer Offers Fast, Clean Drying, advertisement, undated.

T. K. Fielder, Spectrum Process, undated.

T. K. Fielder, Spectrum Processor Granulator Vacuum Dryer with Microwave Heating, undated.

Advertisement, T. K. Fielder's High Speed Mixer/-Granulator Now Has Vacuum Drying, undated.

*Primary Examiner*—Henry A. Bennet

*Attorney, Agent, or Firm*—Allegretti & Witcoff Ltd.

[57] ABSTRACT

A mechanism for batch drying of a powdered or particular product with a microwave vacuum system is disclosed along with a method of controlling the drying process. The mechanism includes a chamber for drying the product. The product is contained in an internal product container. The product container and chamber are coordinated to allow easy opening on a rail system. The mechanism includes a means for inducing a vacuum in the chamber that can also with draw solvent vapor from the chamber. A source of microwaves for the chamber is provided, and the product container has an agitation mechanism for the product. A means for controlling the drying operation is also disclosed. The preferred embodiment of the mechanism include a solvent recovery system. The method of controlling the drying process allows for the selective halting of the drying operation upon achieving selectable parameters. The control systems also allows selectable parameters to be maintained during the drying operation.

39 Claims, 8 Drawing Sheets

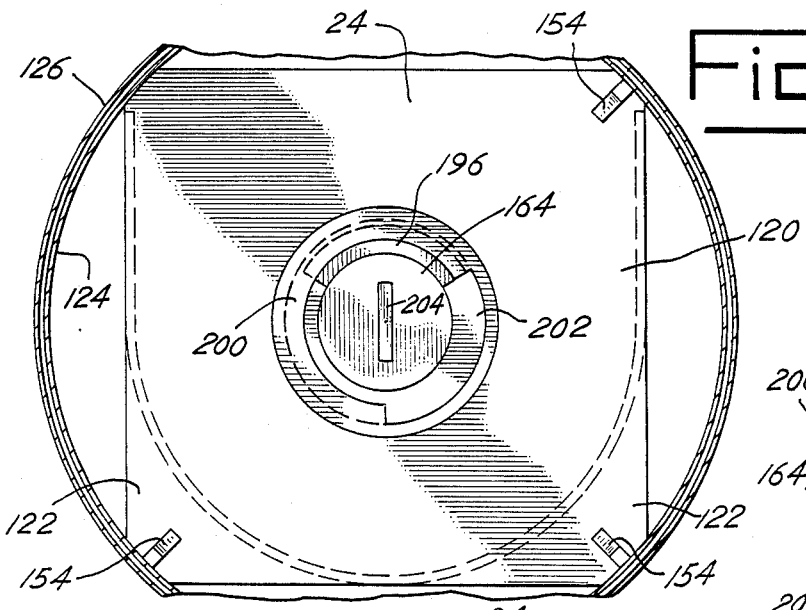
Fig. 11
Fig. 12
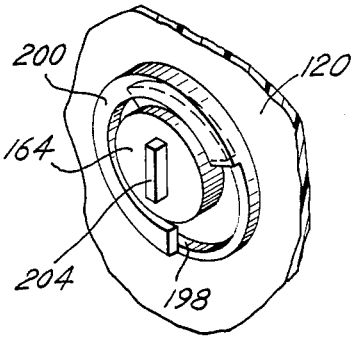
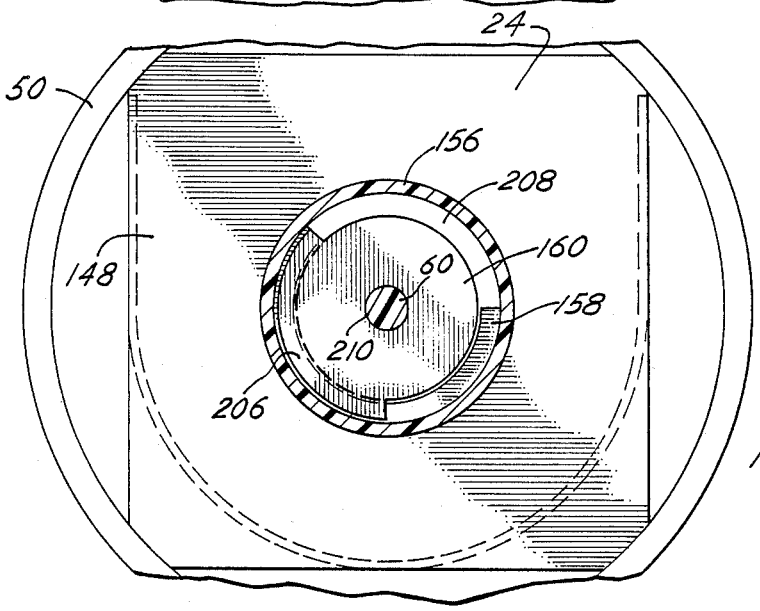
Fig. 13
Fig. 14
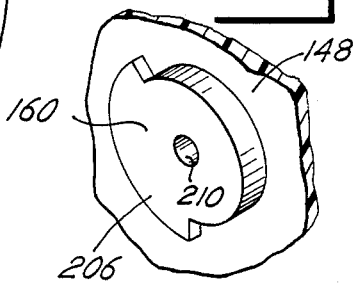
Fig. 10
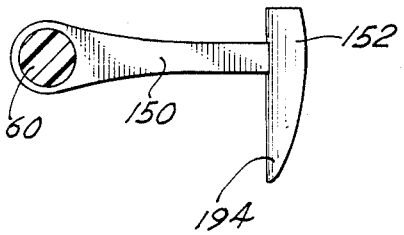
Fig. 8
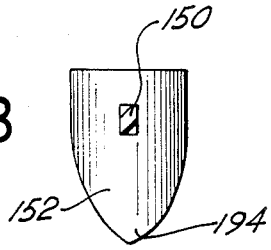
Fig. 9
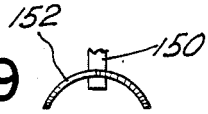

Fig. 15
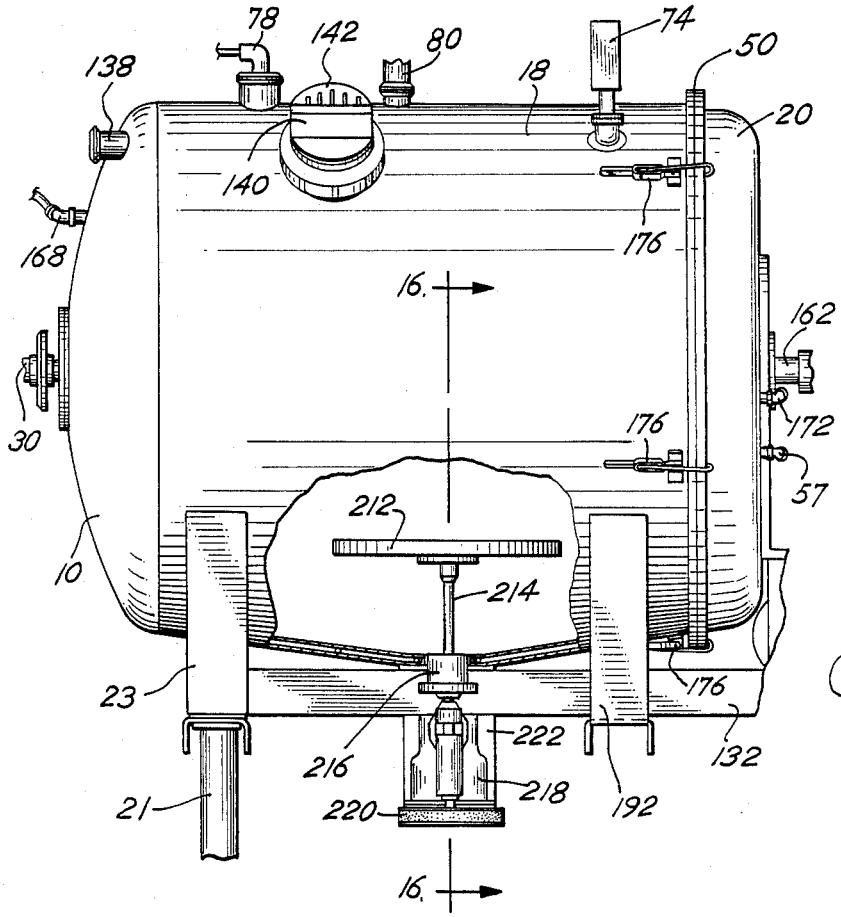
Fig. 16
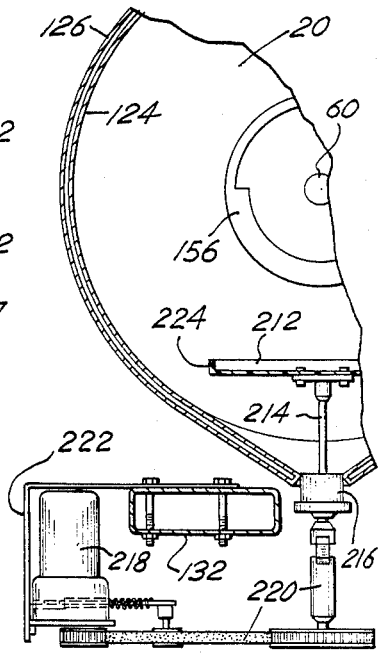
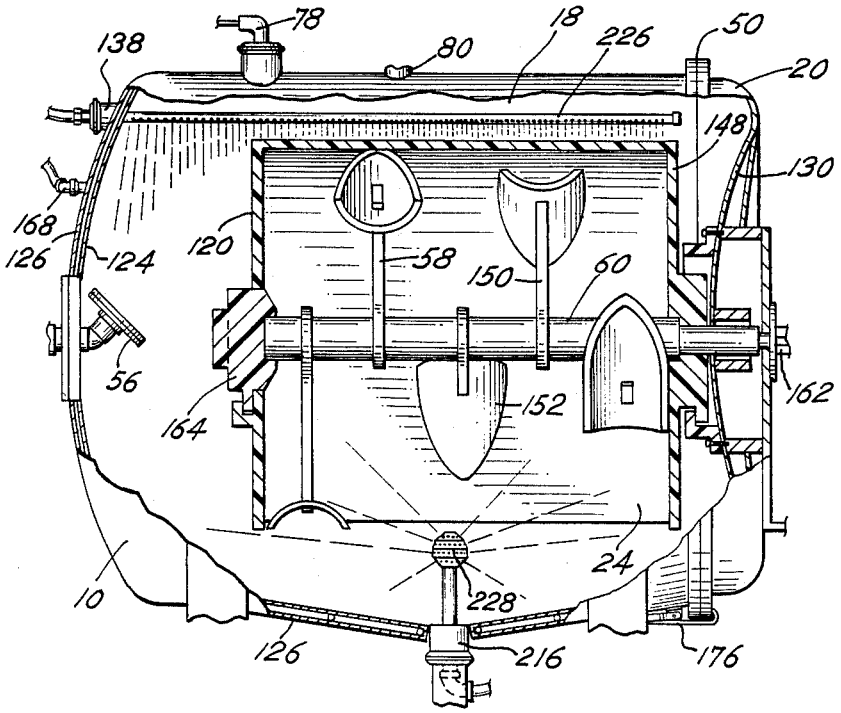
Fig. 17

APPARATUS AND METHOD FOR BATCH DRYING USING A MICROWAVE VACUUM SYSTEM

BACKGROUND OF THE INVENTION

This application relates to mechanisms and processes for drying products in a microwave field. More particularly, the invention disclosed and claimed in this application relates to an apparatus and method particularly suited for microwave vacuum drying, in batch sequences, of powdered or particulate materials in the pharmaceutical, chemical and food industries.

Microwave vacuum drying on an industrial scale has been used, among other places, in agricultural applications (for seed drying) and in related industries. Such processes normally involve drying products in a vacuum chamber containing a field of microwave energy. The vacuum reduces the boiling temperature of the product's solvent. The solvent is often water but can be a variety of other substances. The microwave energy raises the temperature of both the product and its solvent to the solvent's boiling temperature, and then provides the latent heat of vaporization.

The combination of microwaves and vacuum has been found to produce quick, low-temperature drying with little product loss and little chance for fire or explosion—the latter safety factor is especially important when powdered or dust-containing materials are dried. Additionally, the microwave vacuum drying process provides inherent solvent recovery.

In the past, microwave vacuum drying processes have been applied to a large variety of products. Such processes have, for example, been applied to seed drying, as disclosed in McKinney, U.S. Pat. No. 4,015,341 issued for a "Seed Drying Process and Apparatus", and to frozen materials, as disclosed in Bradbry, U.S. Pat. No. 2,513,991 issued for a "Process for the Desiccation of Aqueous Materials from the Frozen State". The process has also been applied to food products, as disclosed in Jeppson, U.S. Pat. No. 3,409,447 issued for "Treating Food Products with Microwave Energy and Hot Gas of Decreasing Humidity". Microwave vacuum processes have also been used in the pharmaceutical and food industries.

Although some batch microwave drying devices have been built and used in the past, and although batch devices have been used in the pharmaceutical, chemical and food industries, the use of such machines is not well developed. Many of the batch drying machines have been laboratory machines, not wholly suitable for high volume commercial drying. Continuous operations are often suitable in many food and chemical industries. However, batch operations are especially important in the pharmaceutical industry because of federally mandated requirements for records on each batch of pharmaceuticals prepared. Batch drying processes are also useful in the food and chemical industries for products produced in discrete segments or smaller amounts. Accordingly, a need exists for further development in the field of batch microwave vacuum drying in commercial quantities, especially in the pharmaceutical, chemical and food industries.

Vacuum drying operations have limitations different from conventional drying operation. For example, the solvent, often water, will condense at a lower temperature than normal due to the introduction of a vacuum. The lower condensation temperature will cause the walls and windows of the drying chamber to be covered with solvent condensate, which will accumulate in the chamber unless some means is provided to prevent condensation or to remove the condensate.

Use of a microwave drying process poses other problems, most stemming from the likelihood of uneven microwave distribution within the dying chamber. Microwaves can only penetrate the product to be dried to a limited depth, a depth that varies from about one quarter inch to four inches, depending on the product. To protect workers and operators of the drying apparatus, microwave devices must also have a complete metal enclosure; yet the field strength of microwaves becomes zero at the surface of a metal wall. The product must therefore be kept at least one quarter wavelength from the surface of the metal wall, a distance that is approximately 1.2 inches. The shape of the metal container also affects the field strength within the heating chamber. For example, a sharp metal point produces a high field strength at the point's tip. Microwave vacuum dryers therefore should be designed with smooth interior curves to produce few, if any, areas of extreme energy concentration.

In the past, the most common form of microwave vacuum dryers for batch processes have been lab structures with rotating trays. Such trays are usually circular and allow the product to be either loaded directly onto the tray or placed in a container that is set on the tray. Generally, rotating trays are difficult to load and unload, especially if the product is spread on the surface of tray, because the product must be spread evenly across the entire tray. For pharmaceutical or chemical powders, the maximum thickness that will allow even drying is one to two inches. Additionally, even drying throughout the product can be achieved only if the product is kept near the outer edge of the tray, since the movement of the product through the uneven microwave field is greatest along that edge.

A more suitable approach for batch microwave drying is the use of product container in the form of a tumbling drum. Such drum configurations have been attempted by the inventor, but have posed several problems. The entire drum must be transparent to microwaves, which for all practical purposes requires the drum be constructed of hard microwave-transparent plastics. Such plastics, however, make poor gaskets, meaning that difficulties arise in sealing the drum to contain the product. Additionally, a vapor exhaust point must be provided in the drum, and the most convenient location for that exhaust point is the axis of rotation. If a small opening is used, the opening will act as a venturi, increasing the velocity of the exiting vapor so that the vapor will flow from the drum at a high velocity. The high velocity vapor movement will usually pull powders or other granulated material along with the vapor. A larger opening will reduce the venturi effect, but will limit the capacity of the drum. Moreover, rotating drums need a microwave transparent rotating mechanism to effect the rotation.

As an alternative to rotating drums, microwave batch vacuum drying operations can be accomplished using a product container having internal agitators. Design of a structure with internal agitation posses a variety of difficulties, including the need for a thorough and even mixing with little fracturing of the product. The container design also should avoid corners that will trap the product to be dried and prevent standing water or solvent spots. Any container design must also allow easy loading and unloading of the product.

Control of a batch microwave vacuum drying process requires consideration of several factors. For example, microwaves are most often absorbed better by the product solvent than the product itself. The amount of energy absorbed by the product/solvent combination therefore decreases as the percentage of solvent within the product decreases. During vaporization of the solvent, the combined product/solvent temperature will remain relatively stable, since energy absorbed by the solvent will be used for the vaporization. However, as vaporization nears completion, the combined product/solvent temperature will begin a more rapid temperature change, if the microwave field is not changed to compensate.

Different products also have different drying requirements. For example, the maximum temperature that is acceptable for a product varies depending upon the product. Additionally, different products may require different degrees of solvent retained within the product; complete drying is rarely desirable.

One conventional form of control for drying processes is a simple elapsed time control that halts drying after a predetermined period. Of course, other more complicated control systems have been used as well. Elapsed time control, while effective, often does not provide the versatility necessary to precisely control the drying and drying temperature of products. This is especially true for pharmaceuticals, which require exact control of all the product's characteristics.

OBJECTS OF THE INVENTION

Accordingly, it is an object of this invention to provide a microwave vacuum drying apparatus and process that is usable primarily in the pharmaceutical, chemical and food industries.

An additional object of this invention is to provide such a microwave drying apparatus that allows for easy product loading and unloading.

A further object of this invention is to provide a microwave vacuum drying apparatus and process that results in even drying of the product.

Another object of the invention is to provide a microwave drying apparatus and process that operates on a batch basis.

Yet a further object of this invention is to provide a microwave vacuum drying apparatus that is sanitary and easily cleaned.

Still another object of this invention is to provide a microwave vacuum drying apparatus that results in even microwave distribution throughout the dried product.

Yet a further object of this invention is to provide a microwave vacuum drying apparatus and process that results in accelerated drying of the products.

Still another object of this invention is to provide a microwave vacuum drying apparatus that has a commercial volume capacity.

Still a further object of this invention is to provide a microwave vacuum batch drying apparatus and process that provides for even exposure to the microwaves and thus even drying of the product, with little fracturing or destruction of the product elements.

Yet another object of this invention it to provide a microwave vacuum drying apparatus that prevents solvent condensate from accumulating on the interior walls of the apparatus.

An additional object of this invention is to provide a microwave vacuum drying apparatus and process that is versatile, so that it may be applied to a variety of different products.

A further object of this invention is to provide a versatile control system for a batch microwave vacuum drying apparatus and process.

Yet a further object of this invention is to provide a batch microwave vacuum drying apparatus control and process that is capable of responding to rapid changes in product and drying chamber characteristics.

Still another object of this invention is to provide a microwave vacuum drying apparatus that minimizes product and solvent loss.

SUMMARY OF THE INVENTION

These and other objects of the invention are accomplished by providing a mechanism for batch dryng of powdered or particular products using a microwave vacuum system. A method of controlling the drying process is also provided. The mechanism includes a chamber for drying the product with an internal product container, a means for producing a vacuum in the chamber, a source of microwave energy and a means of introducing that energy into the chamber, an agitation mechanism for the product, and a means for controlling the product's drying operation. The agitation mechanism is integral to the product container. The preferred embodiment of the mechanism also includes a solvent recovery system. The product container and chamber are coordinated to allow easy chamber opening and easy product dumping. The preferred embodiment connects the chamber's head and the product container for joint movement on a rail. The controlling method allows for the selective cessation of the drying operation upon achieving selectable parameters. The control systems also allows selectable parameters to be maintained during the drying operation, if desired.

Other objects, advantages, and applications of this invention are apparent from the following detailed description of the preferred embodiment and explanation of practice of the method of the invention. The description and drawings are intended for purposes of illustration only, and the invention is limited only by the provisions in the claims.

BRIEF DESCRIPTION OF THE DRAWINGS

The principal embodiments of the present invention is disclosed in the detailed description of the drawings. The drawings include eighteen figures to illustrate the embodiments and the practice of the method, wherein like reference numerals in each drawing refer to like elements of the various figures.

The drawings are briefly described as follows:

FIG. 8 is a top cross sectional view of the blade portion of the agitator paddles used in the preferred embodiment of the invention.

FIG. 9 is an end view of the blade of FIG. 8.

FIG. 10 is a side cross sectional view of the paddle of FIGS. 3 and 8, further illustrating the arm of the agitator paddles.

FIG. 11 is a cross sectional view of FIG. 3, illustrating the inner end of the product container.

FIG. 12 is a perspective view of the inner end of the product container illustrated in FIG. 11.

FIG. 13 is a cross-sectional view of the chamber and product container mount of FIG. 3.

FIG. 14 is a perspective view of the product container mount of FIG. 13

FIG. 15 is a cut-away side view of the chamber of FIG. 3 showing a tray as an alternative arrangement for a product container.

FIG. 16 is a cross-sectional view of the embodiment of FIG. 15, illustrating the tray's drive motor and mount.

FIG. 17 is a cut-away side view of the chamber of FIGS. 1 and 3, illustrating operation of a clean-in-place mechanism.

Figure 1:
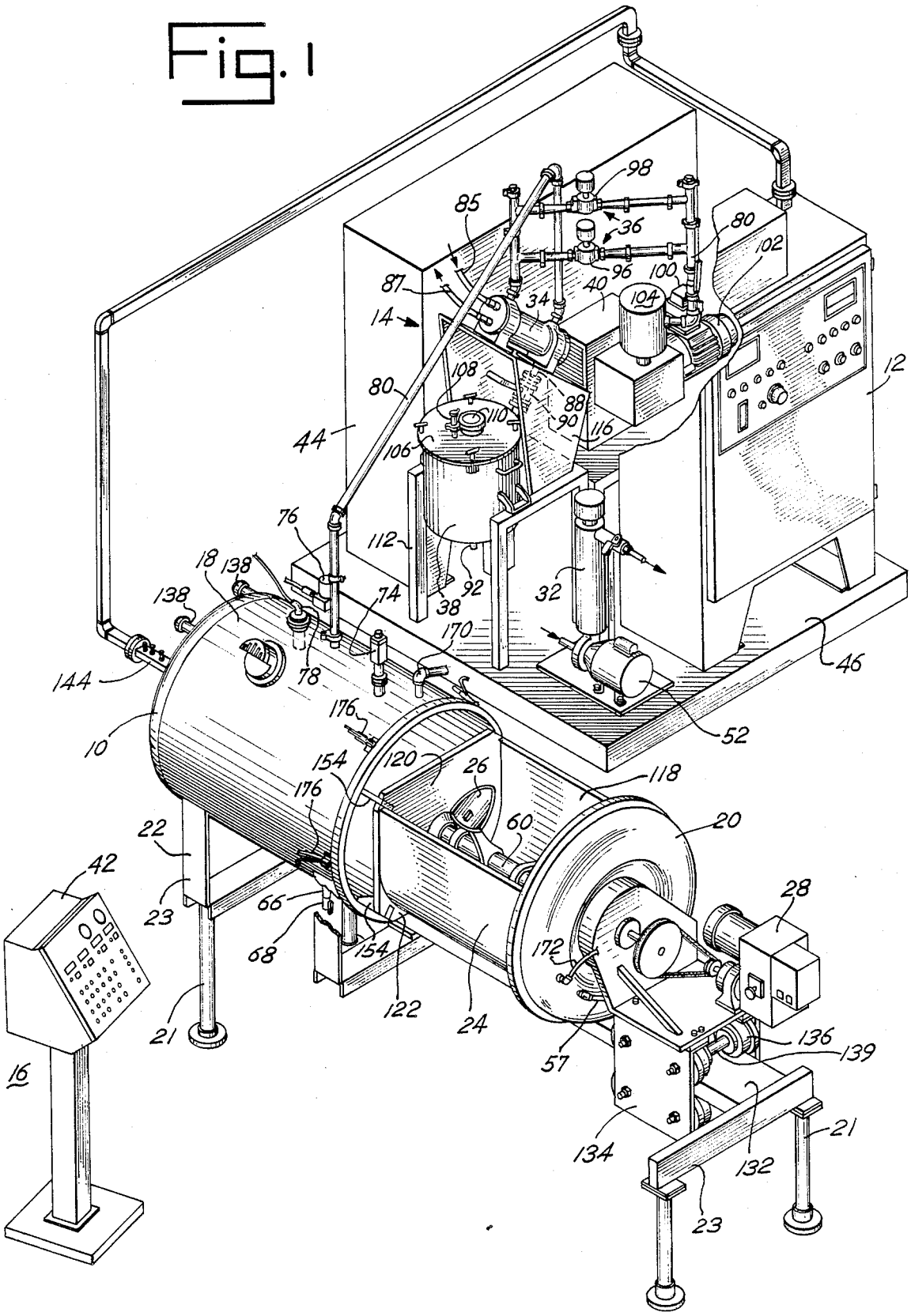
FIG. 1 is a perspective view of the elements of the preferred embodiment of the mechanism of this invention.

In the following detailed description, directional terms such as "upper", "lower" and the like are used for the convenience of a person of ordinary skill in the art, and are not to limit the scope of any patent issuing on the present invention, unless expressly included in the claims.

DETAILED DESCRIPTION OF THE PREFERRED EMBODIMENT AND DETAILED EXPLANATION OF THE METHOD OF THE INVENTION

Referring now to the drawings, an explanation will be provided of the preferred method of practicing the method of this invention, and a description will be made of the preferred embodiment of the mechanism of this invention. It is to be understood that the mechanism described in this description and shown in the attached drawings is only one of several different mechanisms appropriate for the practice of the method of this invention. Similarly, the mechanism described and shown in the drawngs illustrates but a few of the various mechanisms that embody the apparatus claimed. The method and apparatus of this invention are limited only by the language in the claims and not by any statements made in the following description.

The principal elements of the preferred embodiment of the invention are illustrated in FIG. 1. Generally, the invention comprises a drying chamber 10, a microwave generator 12, components of fluid system 14 and a control system 16. Together, those elements comprise the main components of the apparatus in the invention's mechanism and are suitably configured for performance of the method of the invention.

The drying chamber 10 includes a body portion 18 and a chamber head 20. Both the body and the chamber head are mounted on a chamber stand 22. The chamber stand includes legs 21 and frame 23. The body and chamber head are supported by the stand when the chamber 10 is both open and closed; FIG. 1 illustrates the drying chamber 10 opened. The product to be dried is placed in a product container 24. In the preferred embodiment, the product container is mounted on the chamber head 20, but is supported by both the chamber head and body. The preferred embodiment of the mechanism also includes an agitation mechanism 26 driven by a drive motor 28.

The microwave generator 12 is connected to the drying chamber 10 by a wave guide 30. The wave guide is preferably made of aluminum to ensure good transmission and total containment of the microwaves.

The components of the fluid system include a water heater 32, a condenser 34, a chiller 84 (illustrated in FIG. 2), a valve system 36, a condensate reservoir 38, and a vacuum pump 40. The components of the fluid system are connected by a series of hoses that are not entirely illustrated in FIG. 1, but are described in the specification and later figures.

The control system includes a series of sensors, a control and readout unit 42, an electrical component cabinet 44, and interconnecting wiring. The microwave generator 12, fluid system 14, and electrical components cabinet 44 are all, in the preferred embodiment, mounted on an equipment platform 46.

Figure 2:
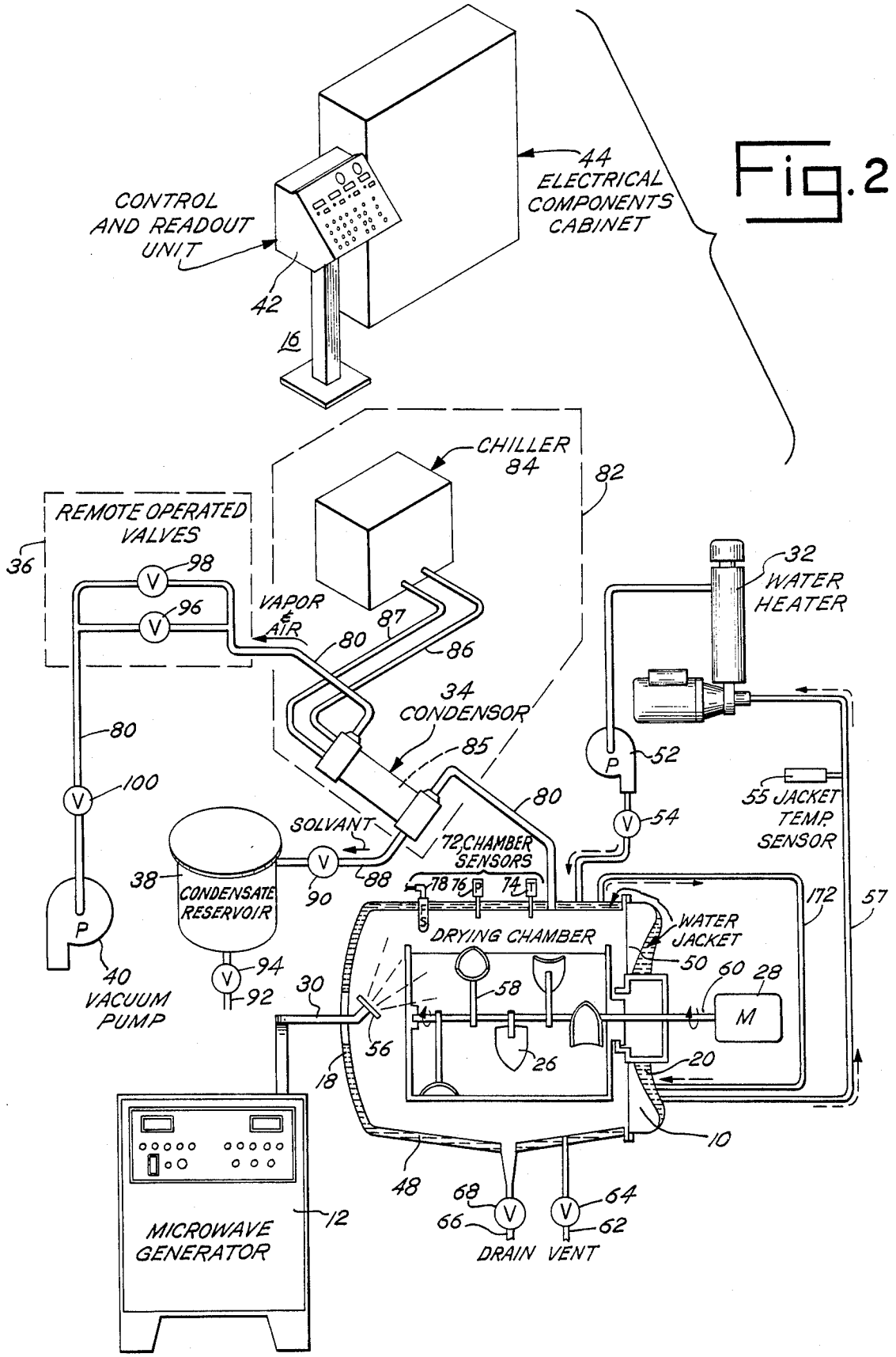
FIG. 2 is pictorial illustration identifying the individual elements of the mechanism and showing the relationship of the various fluids used in the system.

The operative relationship between the various elements is best illustrated by reference to FIG. 2. Beginning with the location of the drying operation, the drying chamber 10 is surrounded by a heated water jacket 48. The warm water provides a heat source to heat the chamber 10 that prevents condensation of vaporized solvent onto the interior of the chamber's surface. A seal 50 separates the chamber main body 18 from the chamber head 20. The water jacket extends around both the main body 18 and the chamber head 20, and is connected between those chamber elements by a hose (not shown) extending across the chamber seal 50. Hot water for the water jacket is provided by the water heater 32. The water is pumped by a water pump 52 to the body portion 18 of the chamber, and after flowing throughout the water jacket, returns from the chamber head portion 20 to the water heater. The water is constantly recirculated since it is used only for heating. In the preferred embodiment, a manually operated valve 54 can be used to shut off flow from the water heater 32 to the water jacket 48. A jacket temperature sensor 55 is positioned in the return line 57 between the chamber head 20 and water heater 32.

Microwave radiation is provided to the drying chamber 10 by the microwave generator 12, and travels through a conventional wave guide 30. The microwave radiation is directed through the microwave inlet window 56, which is positioned to direct the microwaves to reflect off the upper part of the drying chamber 10 and thereafter reflect throughout the chamber 10.

An agitation mechanism 26 is mounted in the product container 24. It includes paddles 58 rotating about a shaft 60 and extending through the chamber head 20. The shaft 60 is driven by the drive motor 28. The drying chamber also includes an air cylinder 70 that separates the chamber head 20 from the chamber body 18 upon a remote command.

The drying chamber also includes a vent 62 to allow the chamber to return to atmospheric pressure. The vent 62 is operated by a remote controlled valve 64.

The chamber also has a drain 66 to allow removal of any condensation that does occur on the drying chambers inner surface. The drain also allows removal of any cleaning fluid in the chamber left after a cleaning operation. The drain is controlled by a manual valve 68.

Chamber sensors 72 are mounted on the drying chamber 10. The sensors monitor conditions within the chamber and send that information to the control and read-out unit 42. In the preferred embodiment, the sensors consist of an infrared product temperature sensor 74, a chamber pressure sensor 76 and a chamber field strength sensor 78. The chamber pressure sensor 76 may be connected directly to the drying chamber, or, as in the preferred embodiment (and illustrated in FIG. 1), may be positioned in the vacuum line 80 extending away from the drying chamber.

The vacuum within the drying chamber 10 is produced by the vacuum pump 40. The vacuum pump draws air and solvent vapor from the drying chamber through the condenser 34 and the remote operated valve system 36. The pump 40, valves 36, and condenser 34 are connected by a vacuum line 80.

The condenser 34 is part of a condenser unit 82, which consists of the condenser, a chiller 84, and the coolant line 86. Coolant flows into the condenser through inlet line 85, and out through outline 87. Condensate from the condenser 34 flows through the condensate line 88 to the condensate reservoir 38. To allow movement of the condensate reservoir and the solvent it contains away from the condenser, condensate valve 90 is located in condensate line 88 between the condenser and condensate reservoir. If desired, solvent condensate can be drained from the condensate reservoir 38 through drain 92. Flow from the condensate reservoir is controlled by manually operated drain valve 94. Because the condenser is acting in a vacuum system, the condensate reservoir is also maintained at the same pressure. Accordingly, valves 90 and 94 are sealed against both liquid and gas leakage, and condensate reservoir 38 is pressure-sealed as well.

Pressure within the drying chamber 10 is maintained by operation of the valve system 36. The entire system is maintained in a vacuum during a drying operation. The valve system consists of a large valve 96 and a small valve 98. Both the large and small valves are remote operated. Two valves are used to ease maintenance of the drying chamber at a constant pressure. Both valves are "two position" valves that are either wholly open or wholly closed. As an alternative, a single valve may be used, such as an diaphragm valve, that provides for varying quantities of flow through the vacuum line 80. When dual valves are used, as in the preferred embodiment, the larger valve is opened by the system's control unit, and air flows from the chamber until the drying chamber achieves the desired drying pressure. The large valve 96 is then shut. Vacuum is maintained at the desired pressure by opening and closing the small valve 98 as necessary, and the vacuum pump 40 operates continuously throughout the drying operation. Through use of that system, an accurate vacuum can be more consistently maintained in the drying chamber 10 than when diaphragm valve is used. In the preferred embodiment of the mechanism, a manual valve 100 is positioned in the vacuum line 80 between the valve system 36 and the vacuum pump 40. If desired, manual valve 100 can be used to stop all flow through the vacuum line 80.

Control of the system is accomplished by electrical equipment contained within the control and read out unit 42 and the electrical component cabinet 44. The sensors, remote operated valves, drive motor, microwave generator, air cylinder, water heater pump, and vacuum pump are controlled by the electronics of the control and read out unit and electrical components cabinet.

Referring again to FIGS. 1, 3 and 4, various details of the elements of the invention's mechanism are further disclosed. Beginning with the fluid system 14, the vacuum pump 40 includes a pump motor 102 and an air filter 104. The condensate reservoir has a removable chamber head 106, a back-to-atmosphere vent 108 and a viewing window 110. In the preferred embodiment, the condensate reservoir 38 rests on a reservoir stand 112 and is removable from that stand. The chamber head 106 of the condensate reservoir is secured with a series of quick-disconnect latches 114.

The condenser 34 is mounted on a condenser stand 116 positioned over the condensate reservoir 38 for easy of flow of condensed solvent into the reservoir. Also in the preferred embodiment, the chiller 84 sets beneath the vacuum pump 40 beneath the legs of the vacuum pump stand.

FIG. 1 illustrates the preferred embodiment of the product container 24. The container includes sidewalls 118 forming a trough. The inner end of the container has a bulkhead 120 with lower flanges 122 extending beyond the radius of the trough 118. The product container 24 is supported in the chamber body 18 by the lower flanges 122.

Figure 3:
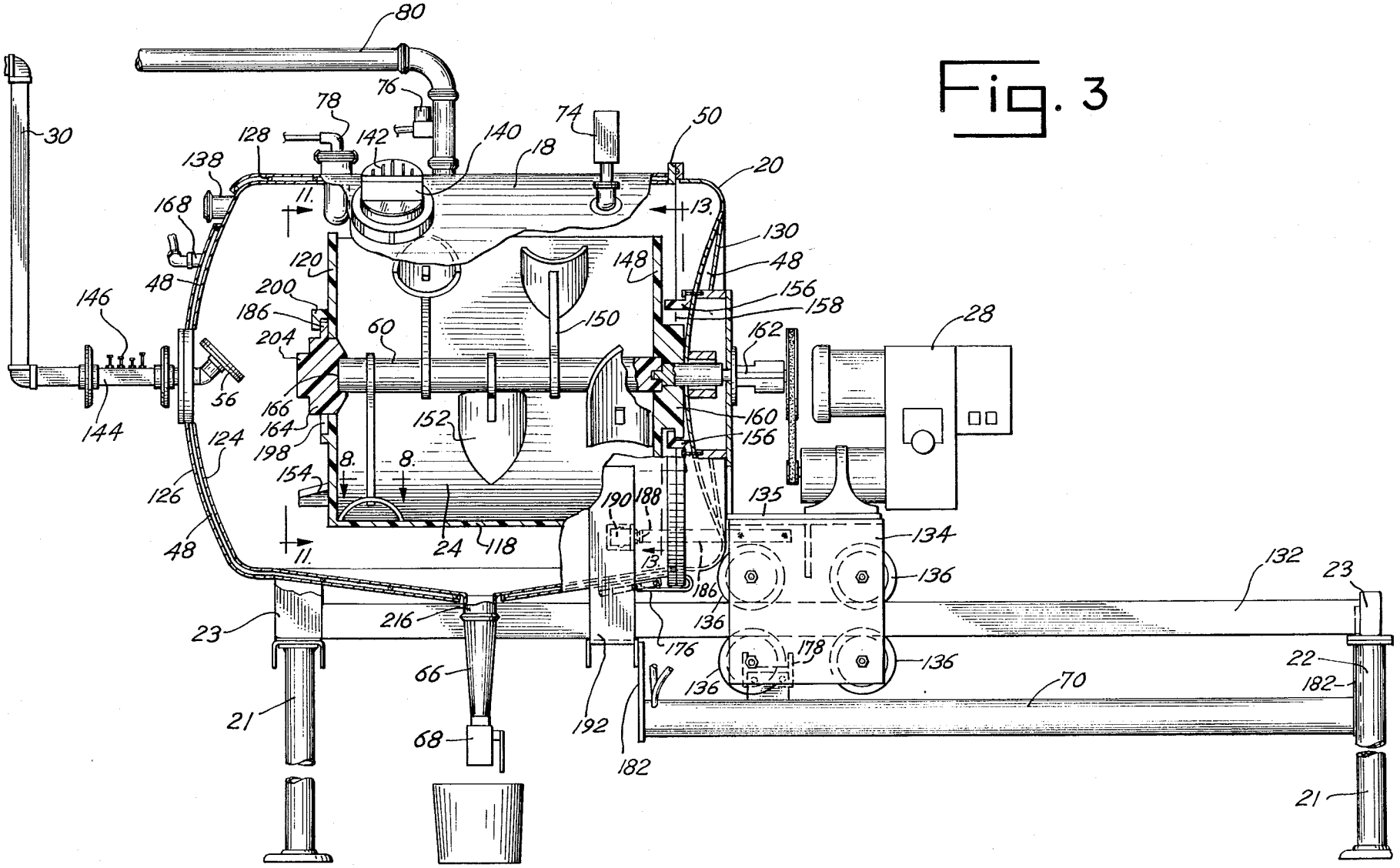
FIG. 3 is a side cut-away view of the preferred embodiment of the chamber of FIG. 1, showing the product container support.

Referring particularly to FIG. 3, additional details of the construction of the drying chamber 10 are disclosed. As that figure illustrates, the drying chamber 10 is constructed of an internal shell 124 and an external shell 126. The space between the shells is maintained by spacer rods 128; that space is the water jacket 48. The spacer rods 128 are composed of a continuous rod wound around the inner shell 124. In the chamber head portion 20 of the drying chamber 10, the water jacket comprises the space between the chamber head 20 and a chamber plate 130. The water jacket for the chamber head 20 extends in an annular configuration around the chamber head's center. It does not extend radially to the chamber head's outer circumference.

Figure 4:
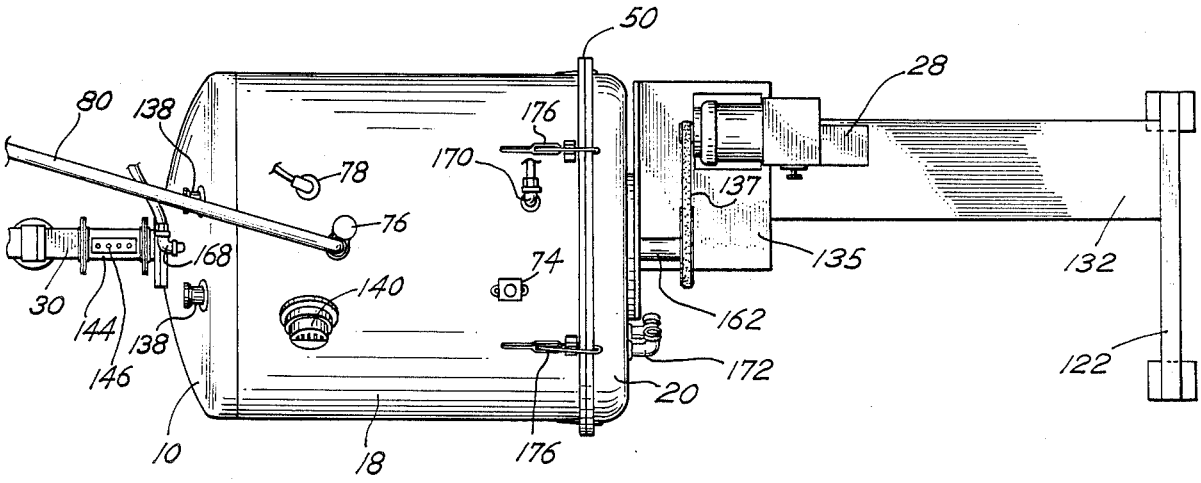
FIG. 4 is a top view of the microwave chamber of FIGS. 1 and 3.

Movement of the chamber head 20 away from the chamber main body 18 is best illustrated by FIGS. 3 and 4. The chamber stand 22 includes a rail 132 extending beneath the drying chamber 10. The chamber head 20 and drive motor 28 are both mounted on a shuttle 134, having a motor mounting plate 135. The shuttle in turn is attached to four rollers 136, two on each side of the rail. Each roller is mounted on an axel 139. Using that configuration, the combined chamber head, shuttle and drive motor unit can roll smoothly along the rail 132 when the drying chamber 10 is desired to be opened.

Other features of the drying chamber 10 are also illustrated on FIGS. 3 and 4. In its preferred embodiment, the drying chamber includes a port 138 through which elements of a clean-in-place system can be installed. The chamber also includes a view window 140 to allow an operator to look into the interior of the chamber. The view window is preferably a glass window having a metal screen covering the glass to prevent transmission of microwaves. In the preferred embodiment, the view window includes an internal light (not shown) mounted within the view window structure and adapted to shine a light into the product container 24. Also in the preferred embodiment, the internal light acts as a heater to prevent condensation of solvent vapor on the window's inner surface. The preferred embodiment of the view window therefore also includes vanes 142 to bleed off excess heat from the view window's light.

The preferred embodiment of the mechanism of the invention also includes a tuning system for the wave guide 30. Thus, a conventional tuner 144 is installed in the wave guide adjacent the microwave inlet window. The tuner operates in the conventional manner, i.e., a series of bolts 146 are threaded into the tuner portion of the wave guide, and reflected power (i.e., power returning into the wave guide) is minimized by adjusting the length of the bolts in the interior of the wave guide by trial and error.

Additional details of the product container and the agitation mechanism are also illustrated by FIG. 3. In the preferred embodiment, the agitation mechanism is a series of paddles 58 mounted about the shaft 60. The shaft 60 is in turn mounted in both the rear bulkhead 120 and the forward bulkhead 148, and can rotate in those bulkheads. Each of the paddles consists of an arm 150 and a blade 152. The paddles are spaced evenly along the length of the shaft 60, and the sum of the widths of the blades 152 is nearly equal to the interior length of the product container 24; the blades can overlap. In that manner, all of the powdered or particulate product within the trough of the product container 24 will be agitated during the drying process, such that the effects of uneven microwave distribution will be minimized. The product container also has three wings 154 extending from the rear of the inner bulkhead 120. The wings 154 support the product container on the inner surface of the inner shell 124 when the product container is pulled from the main body of the drying chamber 18.

In the preferred embodiment, the product container 24 is mounted on the chamber head 20. Preferably, the mounting is accomplished by a radial tongue and groove arrangement. Thus, the chamber head 20 includes a mounting bracket 156 defining a groove 158. The mounting bracket and groove extend radially around the shaft 60, which extends out of the product container 24 through the forward bulkhead 148. Outside of the product container, the shaft 60 has a radial tongue 160 mateable with the groove 158. The tongue and groove mounting arrangement thereby holds the product container 24 against the chamber head 20, when the chamber head is opened by rolling the shuttle and chamber head along the rail 132 as best illustrated in FIG. 1.

Power from the drive motor 28 is transmitted to the shaft 60 through a drive shaft 162. The drive shaft 162 extends into the drying chamber 10 as it locks into the shaft 60 of the bulkhead 148 in a tongue and groove arrangement. The shaft 60 is thus removable from the drive 162 merely by pulling the shaft 60 away from the notch. In the embodiment illustrated in FIGS. 3 and 4, the power transmission between the drive motor 28 and the drive shaft 162 is by means of a pulley 137. Other means may be used without departing the scope of the invention, such a direct drive structure.

In the preferred embodiment of the invention, the shaft 60 is removable from the product container 24. Removability is accomplished by supporting the inner end of the shaft 60 in a latch plug 162. The latch plug 162 has a cylindrical hole 166 matching the shaft 60, and the shaft 60 is supported by and allowed to rotate freely in the cylindrical hole 166. The latch plug 164 is then made to be removable from the inner bulkhead 120, thereby allowing disassembly of the latch plug, shaft and product container into separate elements from the chamber head.

To eleminate arcing, glow discharge and related microwave phenomena, the components of the mechanism that are contained within the drying chamber 10 need to be constructed of a material that is relatively transparent to microwaves. In the preferred embodiment, that material is polypropylene, although a variety of other materials are acceptable as well.

The input to the water jacket is hose and pipe unit 168. After flowing radially around the inner shell 124, the heating water exits from the exit pipe 170, as best illustrated in FIG. 4. A hose (not shown) then leads to the chamber head's water inlet 172, allowing circulation of the hot water in the chamber head before the water returns to the water heater 32 through return line 57.

Figure 5:
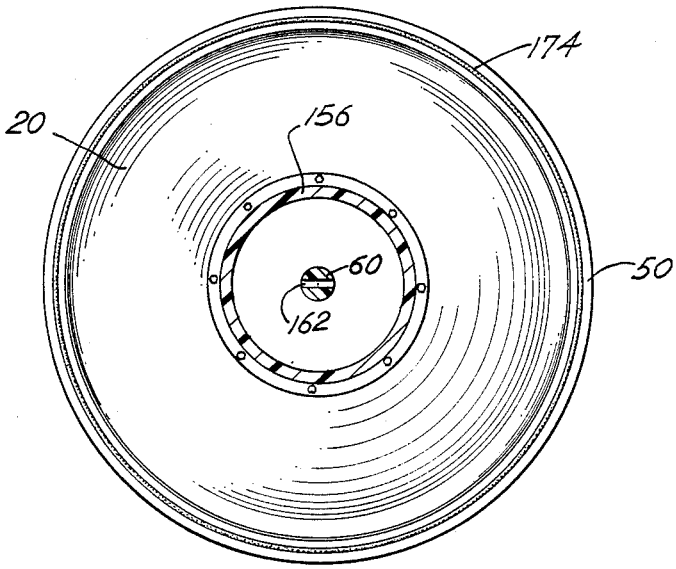
FIG. 5 is a cross-sectional view of the chamber of FIG. 3, illustrating the chamber head and its seal and the shaft of the product agitation system.

The chamber seal 50 between the chamber main body 18 and the chamber head 20 is best illustrated by reference to FIG. 5. The seal is configured to ensure electrical conduction across the entire surface of the joint between the chamber head 20 and the chamber main body 18, and thereby prevent microwave leakage. Accordingly, the seal includes an O-ring 174 composed of a conductive material. FIG. 5 also illustrates extension of the shaft 162 through the chamber head. The same figure further illustrates attachment of the mounting bracket 156 to the chamber head.

Figure 6:
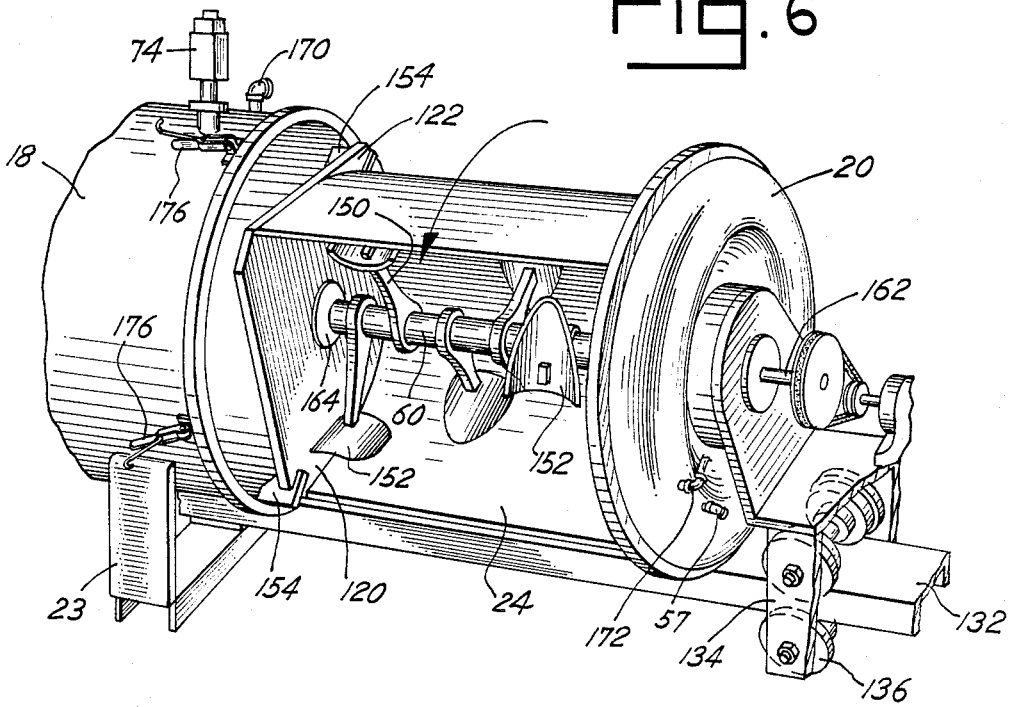
FIG. 6 is a perspective illustration of the chamber illustrated in FIGS. 1 and 3, and further illustrating the mechanism for dumping dried product from the chamber.

Dumping of the product is best illustrated by reference to FIG. 6. Because the product container 24 is rotatable in the mounting bracket 156 about the axis of shaft 60, the product may be dumped from the product container 24 by rotating the container such that its open top is directed generally downward. Since the dried product is either powdered or granulated, the product will slide out of the smooth surface of the polypropylene container. It may be necessary, however, to manually rotate the shaft 60 to move the paddles from blocking flow of the product. When the product container is rotated, its inner end is supported by the body portion 18 of the chamber through the wings 154 extending from the inner bulk at 120. As illustrated in FIG. 6, the product container 24 can be constructed with only three wings. The fourth wing is helpful, but unnecessary to support the product container. Elimination of the fourth wing makes insertion of the product container into the chamber 10 less difficult.

FIG. 6 further illustrates various features of the chamber and its agitation mechanism. FIG. 6 includes illustration of the inner side of the latch plug 164, and the latches 176 that serve to clamp the chamber head 20 to the body 18 in a firm grip.

Figure 7:
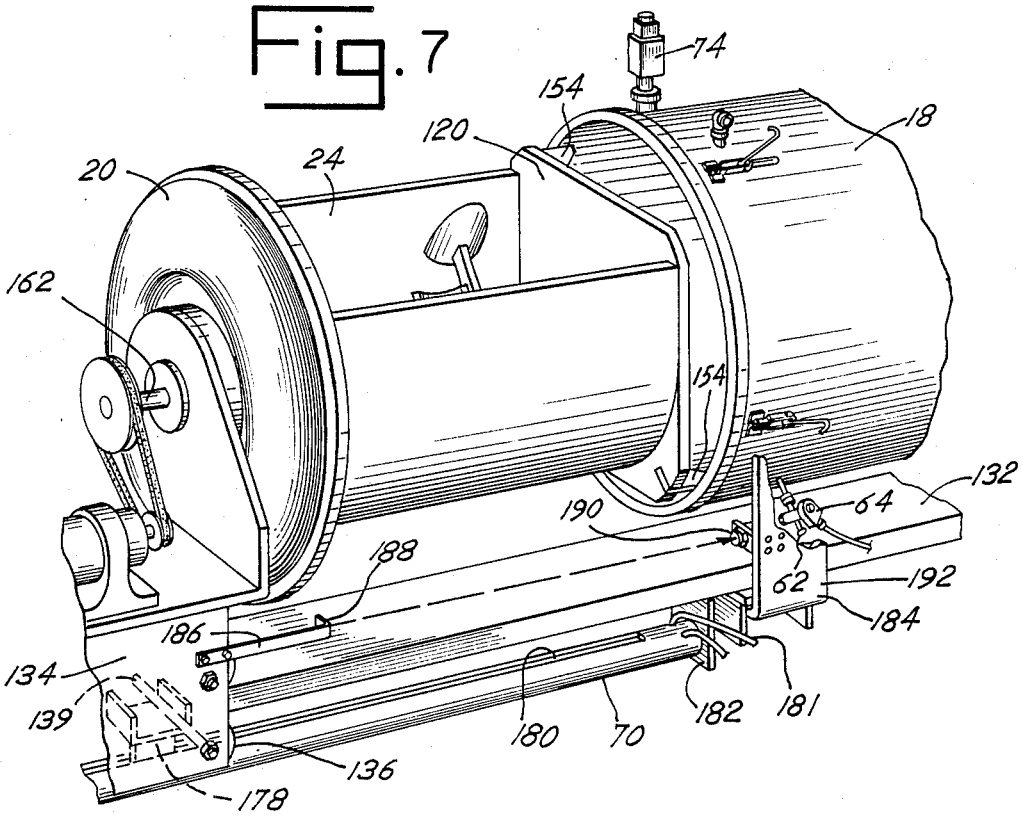
FIG. 7 is a rear perspective view of the chamber of FIGS. 1 and 3.

Referring now to FIG. 7, the preferred embodiment of the invention includes an air cylinder 70 allowing remote opening of the chamber head 20 from the body 18. In the preferred embodiment, the air cylinder is a rodless cylinder, having output rod 178 that moves in a slot 180. The air cylinder is preferably mounted by cylinder supports 182 affixed to the bottom of the rail 132 and operate by acting to move the axles 139 of the rollers 136.

FIG. 7 further illustrates the preferred location and configuration of the back-to-atmosphere vent 62 and its remote control valve 64. The vent and valve are located on the lower portion of the product chamber. The vent and valve are therefore beneath the product container 20 to prevent powdered product from being blown out of the product container or off the tray when the chamber is vented.

Still referring to FIG. 7, the preferred embodiment of the invention includes a safety proximity switch mechanism 184 used to determine if the body 18 and the chamber head 20 of the chamber have been closed. A switch arm 186 extends from the shuttle 134 and includes a sensed surface 188. A proximity switch 190 is mounted on a switch support 192 such that the switch 190 is activated by sensing the surface 188 when the chamber head 20 is closed against the body 18. The switch 190 then sends a signal to the control and readout unit 42, indicating that the chamber is closed. The controller is also programmed such that the microwave power cannot be operated if a vacuum is present. In the preferred embodiment, a drying process cannot begin if the chamber is open.

The particular configuration of the preferred embodiment of the agitators paddles is disclosed in FIGS. 8, 9 and 10. In the preferred embodiment, the arm 150 of each paddle 58 is affixed around the shaft 60. Each blade 152 is affixed to the end of the arm 150, opposite the shaft. Each blade is curved, with the concave portion of the curve pointing away from the arm 150. Each blade 152 also has a pointed end 194. The point is sharp enough to ease passage through the powdered or particular material, but not so sharp that the blade will damage large, soft particulate product.

The shaft rotates clockwise as viewed in FIG. 10, so that the point 194 is in the direction of paddle rotation. As best illustrated in FIG. 10, the blade width, measured in the radial direction from the shaft 60, is small near the pointed end 194 and expands to a maximum where the blade 152 contacts the arm 150. The curved configuration of the balde 152 acts to gently lift powdered or particulate material during agitation. However, the point 194 is not excessively sharp; together with the lesser radial width of the blade 152, it serves to minimize damage to product during agitation, especially large, soft particulate food items.

Referring now FIGS. 11 and 12, the mechanism for removal of the shaft 60 and the paddles 58 from the product container 24 is disclosed. The latch plug 164 includes an arcuate tongue 196 extending outward from the axis of the shaft 60. The tongue 196 mates with the radial groove 198 formed between a plug bracket 200 and the inner bulkhead 120. The radial groove 198 has an opening 202 slightly larger than the arcuate tongue 196. The latch plug 164 can then be removed from the product container 24 by manually rotating the plug until the tongue 196 has moved in the radial groove 198 such that the tongue is entirely within the opening 202. To ease that rotation, the latch plug 164 has a knob 204.

FIG. 11 also illustrates the respective positions of the lower flanges 122 on the inner bulkhead 120. In the preferred embodiment, the lower flanges 122 act as supports for the product container 24, by resting against the surface of the inner shell 124. Also as illustrated in FIG. 11, the inner bulkhead 120 is configured to fit loosely at all four of its corners against the surface of the inner shell 124.

FIGS. 13 and 14 illustrate the mounting of the product container 24 on the chamber head 20. The radial tongue 160 has an arcuate segment 206 that fits within the groove 158 of the mounting bracket 156. The radially tongue 160 is affixed to the forward bulkhead 148.

Rotation of the product container 24 for dumping of product is accomplished by rotating the filled container. The rotation moves the arcuate segment 206 from the approximate 8 o'clock position (with respect to the shaft 60) to a dumping position at approximately 4 o'clock. The product container can be fully removed from the mounting bracket 156 by rotating the container further such that the arcuate segment 206 corresponds to an opening 208 in the mounting bracket. Of course, rotation of the shaft 60 can if not restricted by the shaft opening 210. However, a close fit exists between the shaft 60 and the shaft opening 210 to prevent product leakage through the shaft opening. Ease of movement is primarily effected by the nature of the materials used for both the radial tongue 160 and shaft 60, and by the smooth surface on both the shaft and the inside of the shaft opening 210.

An alternative product container and drive mechanism for that container is illustrated in FIGS. 15 and 16. The alternative embodiment employs a tray 212 inside the drying chamber 10 to hold the product. In the illustrated embodiment, the tray 212 is circular. However, any configuration is appropriate so long as it will hold the product.

The tray embodiment of the product container is driven by a drive motor separate from the normal drive motor 28. In the preferred embodiment of the invention, the condensate drain 66 is removable from the drying chamber 10. The tray 212 can then be rotated about a tray shaft 214 that extends vertically through the drain connector 216. A tray drive motor 218 is then connected through a linkage 220 to the tray shaft 214. The tray drive motor 218 is supported by a motor bracket 222 mounted on the rail 132. In the preferred embodiment, the linkage 220 is a pulley system; however, any linkage that can impart a rotating drive to tray shaft 14 is appropriate.

As best illustrated by FIG. 16, the tray 212 has a rim 224. Product may be placed directly onto the tray 212, if desired, by spreading the product on a tray surface up to the height of the rim. Alternatively, product may be placed in a separate container, with that container placed on the tray 212. Like the product container 24, the tray 212 is composed of a relatively microwave transparent material, preferably polypropylene. Use of the arrangement of FIGS. 15 and 16 is especially appropriate for preliminary testing of a product to determine appropriate drying parameters.

The preferred embodiment of the mechanism of this invention may utilize either the tray 212 as product container, or a trough product container. In both instances, the drive motor imparts a rotation, and is controlled by the electronics of the control and read out unit 42.

The mechanism of the invention is also adapted for use with a clean-in-place system. As illustrated in FIG. 17, the clean-in-place system uses internal elements that spray water on both the product container and the surface of the inner shell 124.

In the preferred embodiment, the clean-in-place system includes a spray bar 226 inserted through the port 138. The spray bar 226 is connected to a water source from which water can be pumped into the drying chamber 10. The spray bar 226 cannot by itself, however, clean all of the components of the product container 24. The preferred embodiment therefore includes a spray ball 228 positioned beneath the product container. The spray ball is inserted through the drain connector 216, after the drain 66 has been removed. In the preferred embodiment, drainage will still occur through the drain connector 216. Operation of the clean-in-place system is best accomplished with the product container 24 rotated to the fully inverted position so that water (or solvent) from the spray ball 228 can be sprayed into the interior of the product container 24. The clean-in-place system can also operate with the drive motor 28 turning the agitation system, so that each of the paddles 58 will be cleaned by the spray from the spray ball 228.

The procedure for using the mechanism of the preferred embodiment of the invention, and particularly the standard trough type product container, begins by filling the product container with product to the center line of the agitation system; that is, to shaft 60. The container is then closed with an effective seal between the chamber head 20 and the main body 18. The chiller, microwave generator, vacuum pump, and water heater are then turned on to allow each to "warm" up. Vacuum pump 40 is then started with large valve 96 open, and a vacuum is pulled in the chamber. In most drying operations, the vacuum is pulled until the pressure in the drying chamber is between ten and thirty-five torr. When the vacuum is at the desired level, the large valve 96 is closed, and the control system, if desired, then opens and closes the small valve 98 as necessary to maintain the vacuum in the drying chamber. Microwave power is then allowed to flow through the wave guide 30 into the drying chamber. The drive motor is activated, and the product is agitated in the presence of the vacuum and the microwave field until drying has been completed. The microwave power is then stopped, small valve 98 is closed, and back-to-atmosphere valve 64 is opened to allow air through the vent 62 into the drying chamber 10. The product can then be unloaded by opening the chamber head 20 and rotating the product container 24 to dump the now-dried product. The process can be repeated as many times as is desired.

In the preferred embodiment of the invention, the mechanism is adapted so that the sequence of drying can either be manually controlled or automatically controlled. Thus, the preferred embodiment of the invention includes automatic controls that can engage the entire start-up sequence, including opening and closing valves as necessary, activating microwave power, halting the drying operation, venting the drying chamber and opening the chamber through operation of the air cylinder 70. Alternatively, each of those acts can be conducted manually.

Figure 18:
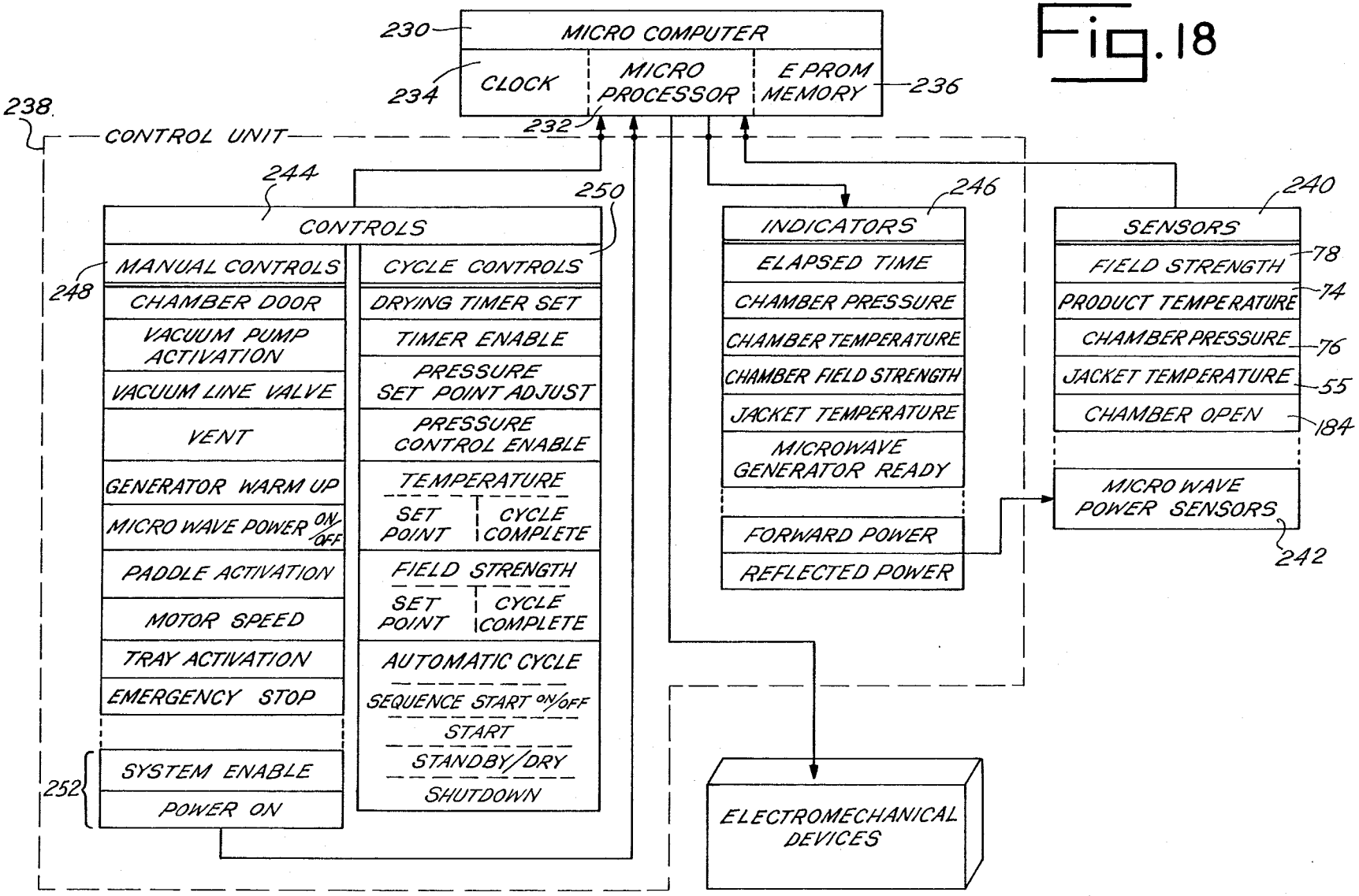
FIG. 18 is a graphic illustration of the control and sensor operation, and their relationship to the control and readout unit.

The controls employed and the alternatives available through use of those controls are best illustrate by reference to FIG. 18. In the preferred embodiment of the mechanism of the invention, the system is governed by a microcomputer 230. The microcomputer is of a conventional configuration, having a microprocessor 232 and internal clock 234. In the preferred embodiment of the invention, the program for the microprocessor can be external, or contained in an EPROM (Erasable Programable Read Only Memory). The microcomputer has such other components as are necessary to its functioning.

Control of the drying process is accomplished through two basic systems, a control unit 238 and a series of sensors 240. The sensors include chamber field strength sensor 78, product temperature sensor 74, chamber pressure sensor 76, and water jacket temperature sensor 55. The system is configured to prevent operation of the air cylinder and thus opening of the chamber if a vacuum is present. Additionally, the safety switch mechanism 184 acts as a chamber "open" sensor. Drying cannot begin if the chamber is open. The microwave generator 12 is of a conventional design that includes microwave power sensors 242 that measure both forward power directed into the drying chamber 10, and reflected power returned from drying chamber to the microwave generator.

The control unit 238 primarily comprises a series of controls 244 and indicators 246. The control unit 238 contains the elements of the control and read out unit 42 (which can be considered to be a remote push-button station), although some of its electronic components are contained in the electric components cabinet 44.

In the preferred embodiment of the invention, eight different parameters are indicated on the control and read out unit: elapsed drying time, chamber pressure, product temperature, chamber field strength, jacket temperature, microwave generator ready (indicating that the generator system is warmed up) forward microwave power, and reflected microwave power. In the prferred embodiment, indicators for each of those are contained on the control and read out unit 42. Of those indicators, all except the forward power and reflected power indicators are processed through the microcomputer. Forward power and reflected power are sent directly from the power sensors 242 in the microwave generator 12.

Control of the process of drying the product may be accomplished either through microcomputer operation of automatic cycles, or through manual operation of the system and human monitoring of the indicators. Thus, the controls include manual controls 248 and automatic cycle controls 250. All automatic cycle controls are operated by the microcomputer.

The manual controls begin with the governing controls 252: "system enable" and "power on". The system enable control is, preferably, a key operated switch that must be set to the proper position before any electronic or electromechanical components of the invention can be operated. The "power on" control simply turns on and activates the other controls on the remote push button station.

Manual operation of the system can occur through operation of 10 different manual controls. Manually, the chamber can be opened through the chamber door control, which activates air cylinder 70. The manual operation controls also include vacuum pump activation, a control for opening vacuum line valve 96, a control for opening the back-to-atmosphere vent 62 through operation of remote control valve 64, a generator electrical power on-off control ("generator warm up"), a control for microwave field activation ("microwave power on/off"), an agitator paddle activation control, a drive motor speed control, and a control for tray motor activation. Additionally, the manual operator controls include an emergency stop switch that shuts down all electrical power to all electromechanical elements in the system. The emergency stop switch operates to shut down all power when used in either the manual or automatic modes.

When automatic control of the drying process is accomplished, the preferred embodiment of the mechanism is programable to selectively halt the drying process upon the occurrence of any of a number of different events. To begin with, the system can be programed to halt drying upon passage of a preset elapsed time. Alternatively, the microcomputer can be programed to halt drying upon achieving a particular product temperature. This feature is especially useful, since product temperature will begin a sudden increase when solvent vaporization has been nearly completed. As a further alternative, the system can be programed to halt the drying operation upon sensor detection of a particular microwave field strength. This feature reflects a characteristic of microwaves, in that microwaves are primarily absorbed by the solvent. When the solvent has been fully vaporized and withdrawn by the vacuum system from the drying chamber, fewer microwaves will be absorbed, and the field strength within the chamber wil increase. Thus, an increase in microwave field strength is an indicator of completion of the drying process.

In addition to halting the drying process upon achieving particular parameters, the system can also be set to maintain either chamber pressure, product temperature, or microwave field strength at predetermined levels. Thus, the operator determines the operating pressure and sets that pressure on the control and read out unit. The operator can also set a chosen product temperature, and the system can adjust to maintain that temperature throughout the operation. Finally, the system can be set to maintain a particular microwave field strength at a value to be chosen by the operator, throughout the entire drying operation.

In the preferred embodiment, the microcomputer is programed and the controls are configured so that field strength and product temperature can be either maintained at preset levels, used as a stopping point for the drying operation, or not made any part of the automatic control. Chamber pressure can be either maintained at a particular level or not made part of the automatic control. Finally, the elapsed time setting need not be used, but the automatic system can function without stopping after a preset elapsed time. The microcomputer is programed such that if multiple parameters are chosen as halting points for the drying process, drying will be stopped upon reaching the first of those parameters. Thus, for example, the system can be set so that a particular elapsed time is chosen for halting the process, and the process is set to halt upon reaching a particular product temperatue, and the process is further set to halt upon reaching a chamber particular field strength. The drying process will then stop when any of those preset parameters are reached. Of course, any combination of elapsed time, temperature, or field strength, or in none of those parameters, can be selected as part of the automatic process.

As best illustrated in FIG. 18, the preferred embodiment of the mechanism includes thirteen different cycle controls. First, the controls include a timer allowing a particular drying time to be set. The controls also include a "timer enable" that switches the automatic cycle from a timed system to a "not timed" system. Similarly, the cycle controls include a pressure setting ("pressure set point adjustment"), and a "pressure control enable" that allows the cycle control to either maintain the set pressure, or not consider pressure to be any part of the control of the cycle.

Product temperature may also be set at an operator desired level. The controls include a temperature control selection that allows the preset temperature to either be a temperature maintained by the microcomputer throughout the drying process ("temperature set point"), or a temperature that the microcomputer will use a stopping point ("cycle completion"). Similarly, microwave field strength can be preset, and the controls include both a field strength setting ("field strength set point"), and a field strength control selection that allows field strength to be either be the process stopping point ("cycle complete") or a particular level to be maintained throughout the drying process.

The cycle controls further include a switch that enables the automatic control system, i.e., the microprocessor ("sequence start and/off") and a switch that starts the automatic cycle, including the start up cycle ("start"). The controls also include a switch that moves the automatic controls to standby disabling the parameters that are controlling the automatic cycle ("standby/-day"), and a shutdown cycle control, which moves the mechanism through the full cycle from an operation made, to zero field strength, vented to atmospheric pressure, and with the chamber lip open.

Finally, as best illustrated in FIG. 18, the microcomputer will not only receive input from the controls, indicators, and sensors, the microcomputer will control all of the electromechanical devices as well, including the condenser unit 82, the vacuum pump 40 the remote operated valves 36, the back-to-atmosphere valve 64, and the water heater 32.

Although both preferred and alternative embodiments of the present invention have been set forth in the above detailed description, it is to be understood that the invention is limited only by the following claims and their equivalents.

What is claimed is:

1. A mechanism for batch drying of a powdered or particulate product, comprising, in combination:

a chamber for drying the product;

a container for the product, rotatably mounted in the chamber to allow dumping thereof;

means for introducing microwaves into the chamber;

means for producing a vacuum in the chamber;

agitation means for agitating the product in the container during drying, said agitation means including a plurality of paddles rotating about a shaft within the container; and means for controlling the product's drying.

2. A mechanism as claimed in claim 1, wherein the product container has an open top and can be rotated while mounted in the chamber to position the container with its top down for product dumping.

3. A mechanism as claimed in claim 1, wherein the product container is removable from the chamber.

4. A mechanism as claimed in claim 1, wherein the means for producing a vacuum also can remove solvent vapor from the chamber.

5. A mechanism as claimed in claim 4, wherein the mechanism further comprises a condenser for solvent vapor that is removed from the chamber.

6. A mechanism as claimed in claim 5, wherein the mechanism further compises a sealed condensate receiver adapted to receive condensed solvent from the condenser.

7. A mechanism as claimed in claim 1, wherein the chamber comprises:

a body having a heating jacket to prevent solvent condensation on the chamber's inner surface; and a chamber head, with the chamber head adapted to move on a rail away from the body, and further adapted to use the heating system of the body to prevent condensation of the chamber head's inner surface.

8. A mechanism as claimed in claim 7, wherein the heating jacket operates by placing hot water around the chamber.

9. A mechanism as claimed in claim 7, wherein the product container is removably attached to the chamber head, and is removed from the chamber body by moving the chamber head on the rail away from the chamber body.

10. A mechanism as claimed in claim 9, wherein the product container is rotatable on the chamber head for removal of the product from the container.

11. A mechanism as claimed in claim 10, wherein the chamber is elongated about a longitudinal axis, the chamber head comprises a segment of the chamber at one end of the axis, and the product container rotates about the axis.

12. A mechanism as claimed in claim 11, wherein the container can be removed from the chamber head by further rotation of the container.

13. A mechanism as claimed in claim 1, wherein the chamber includes a clean-in-place system.

14. A mechanism as claimed in claim 13, wherein the clean-in-place system comprises:

one or more sources of solvent spray; and a solvent drain.

15. A product container for use in a microwave vacuum drying mechanism, comprising, in combination:

a basin with an open top;

agitation means for agitating product within the basin, including a plurality of paddles rotating about a shaft within the product container; and attachment means for attaching the basin inside the microwave drying mechanism, the attachment means being adapted to allow the basin to rotate for product dumping such that the open top is directed downwardly.

16. A product container as claimed in claim 15, wherein each paddle comprises:

an arm mounted on the shaft at one end; and a blade mounted on the arm's opposite end, with the blade configured as an inverted scoop having a concave side and a convex side, with the concave side positioned toward the surface of the container, and with the blade further configured with a point on the rotationally forward side of the blade.

17. A product container as claimed in claim 15, wherein the paddles and shaft may be removed from the product container.

18. A drying chamber for a microwave vacuum drying mechanism adapted for batch drying and capable of holding a product container, the mechanism including a structure adapted to rotationally agitate the product being dried, the chamber comprising, in combination:

a shell internally reflective of microwaves;

a removable chamber head that mates with the shell at a joint;

a heating jacket surrounding the shell and chamber head, and separable into two parts at the joint between the shell and chamber head;

a conductive, flexible seal at the joint between the shell and the chamber head;

a drive motor mounted on the chamber head, the motor being adapted to drive the agitation structure;

a first support for the product container, the support being mounted within the chamber;

a second support for the chamber head when the chamber head is both open and closed.

19. A chamber as claimed in claim 18, further comprising an air cylinder to move the chamber head on the rail upon command from a remote control unit.

20. A chamber as claimed in claim 19, further comprising a sensor indicating lack of a seal between the shell and chamber head.

21. A chamber as claimed in claim 20, wherein the support for the product container is mounted on the chamber head, and the drive motor drives the agitation structure by a shaft running through the support.

22. A chamber as claimed in claim 21, wherein the support for the chamber head comprises:

a rail;

a shuttle attached to the chamber head and mounted on the rail, the shuttle having one or more rollers adapted to roll on opposite sides of the rail, the shuttle further having a platform to support the drive motor.

23. A chamber as claimed in claim 22, wherein the shell further comprises a drain having a removable valve.

24. A chamber as claimed in claim 22, wherein the product container can be replaced with a product tray having a shaft, with the shaft extending through the drain with the valve removed, and the shaft is rotationally driven by a second drive motor mounted on the exterior of the chamber.

25. A mechanism for batch drying of powdered or particulate product through combined application of a microwave field and a vacuum to the product, the mechanism having a source of microwave radiation and vacuum producing structure, the mechanism comprising, in combination:

a drying chamber in which the vacuum and microwave field are applied to the product, the chamber having a microwave reflective interior and removable chamber head;

a product container integrally mounted on the chamber head such that removal of the chamber head extracts the container from the chamber, with the product container being rotatable for product dumping and relatively transparent to microwave radiation;

an agitation mechanism integrally mounted to the product container and configured to move product within the prodcut container during microwave vacuum drying, the agitation mechanism being relatively transparent to microwave radiation; and a drive system for the agitation mechanism, the drive system being external to the chamber.

26. A mechanism for batch drying of powdered or particulate product as claimed in claim 24, wherein the product container is configured as a trough, open at its top, and adapted to be supported during rotation by both the chamber head and the interior of the product chamber.

27. A mechanism for batch drying of powdered or particulate product as claimed in claim 24, wherein the container is removably attached to a mounting bracket affixed to the chamber head, with the mounting bracket configured to allow product dumping after rotation of the container a first distance about the mounting bracket, and removal of the container from the mounting bracket after rotation of the container a second distance about the mounting bracket.

28. A mechanism for batch drying of powdered or particulate product as claimed in claim 26, wherein the agitation mechanism is supported by the mounting bracket, and removal of the product container from the mounting bracket also removes the agitation mechanism from the mounting bracket.

29. A mechanism for batch drying of powdered or particulate product as claimed in claim 27, wherein the agitation mechanism comprises:

a shaft extending through the product container through the mounting bracket, and supported at one end by the mounting bracket and at the remaining end by the container, with the shaft being rotatable about its longitudinal axis;

a plurality of mixing arms attached at one end to the shaft and adapted to rotate about the shaft's axis when the shaft rotates, each arm having a blade attached to arm at the end opposite the shaft.

30. A mechanism for batch drying of powdered or particulate product as claimed in claim 24, wherein the drying chamber includes a heating jacket, and the jacket applies heat to both the chamber and the chamber head.

31. A mechanism for batch drying of powdered or particulate product as claimed in claim 24, wherein the chamber includes a remote operated vent to allow the chamber to return to atmospheric pressure after drying.

32. A mechanism for batch drying of powdered or particulate product as claimed in claim 24, further comprising a solvent recovery system to recover solvent vapor for reuse.

33. A mechanism for batch drying of powdered or particulate product as claimed in claim 31 wherein the solvent recovery system comprises:

a vacuum pump that draws solvent vapor from the chamber;

a condenser that returns the removed solvent vapor to the liquid phase; and a sealed condensate reservoir that holds the condensed vapor for subsequent reuse.

34. A mechanism for batch drying of powdered or particulate product as claimed in claim 24, wherein the chamber's head is mounted for rolling movement on a rail, and movement if effected by a remote operated air cylinder.

35. A mechanism for batch drying of powdered or particulate product as claimed in claim 34, wherein the drive system is a motor mount on the chamber head and configured to move with the chamber head on the rail.

36. A mechanism for batch drying of powdered or particulate product as claimed in claim 24, further comprising:

means for sensing temperature or microwave field strength in the chamber; and means for halting a drying operation upon reaching a predetermined chamber temperature or microwave field strength.

37. A mechanism for batch drying of powdered or particulate product as claimed in claim 35, further comprising means for maintaining the chamber pressure constant during the drying operation.

38. A mechanism for batch drying of powdered or particulate product as claimed in claim 35, further comprising means for halting a drying operation after a predetermined elapsed time.

39. A mechanism for batch drying of powdered or particulate product as claimed in claim 35, further comprising means for maintaining the chamber temperature or chamber field strength constant during a drying operation.

* * * * *